US005248089A

United States Patent [19]

Bekius

[11] Patent Number: 5,248,089

[45] Date of Patent: Sep. 28, 1993

[54] COMBINATION CARRYING CASE/PAINT CONTAINER

[75] Inventor: Wayne Bekius, Milaca, Minn.

[73] Assignee: Wagner Spray Tech Corporation, Minneapolis, Minn.

[21] Appl. No.: 474,684

[22] Filed: Feb. 6, 1990

Related U.S. Application Data

[63] Continuation of Ser. No. 232,082, Aug. 15, 1988, abandoned.

[51] Int. Cl.[5] ..... B05B 9/08

[52] U.S. Cl. ..... 239/154; 239/332; 239/600; 222/175

[58] Field of Search ..... 206/515; 239/152–154, 239/289, 600, 332, 360; 222/175, 182, 609, 620, 179.5, 173, 538, 539

[56] References Cited

U.S. PATENT DOCUMENTS

| | | | |
|---|---|---|---|
| 1,135,739 | 4/1915 | Stoehr . | |
| 1,320,429 | 11/1919 | Wachman | 222/538 |
| 1,465,856 | 8/1923 | Marsh . | |
| 1,600,379 | 9/1926 | Werneman | 222/538 |
| 2,040,327 | 5/1936 | Olesen . | |
| 2,041,173 | 5/1936 | Fairchild . | |
| 2,504,487 | 4/1950 | Anson . | |
| 2,529,645 | 11/1950 | Winks et al. | 222/175 X |
| 2,723,781 | 11/1955 | Funke | 222/175 |
| 3,020,579 | 2/1962 | O'Connor . | |
| 3,298,575 | 1/1967 | Larson | 239/288 X |
| 3,304,573 | 2/1967 | Stefely . | |
| 3,457,017 | 7/1969 | Bastian . | |
| 3,503,691 | 3/1970 | Kirch . | |
| 3,603,694 | 9/1971 | Hamm . | |
| 3,640,630 | 2/1972 | Walker . | |
| 3,676,010 | 7/1972 | Kirch . | |
| 3,768,732 | 10/1973 | Curtis et al. . | |
| 4,420,097 | 12/1983 | Motsenbocker | 222/175 X |
| 4,461,424 | 7/1984 | Faltus | 239/288.5 |
| 4,540,301 | 9/1985 | Swanson et al. . | |
| 4,588,318 | 5/1986 | O'Brien et al. | 239/DIG. 14 X |
| 4,615,485 | 10/1986 | Larson et al. | 239/124 |
| 4,638,948 | 1/1987 | Marlik | 222/538 X |
| 4,639,156 | 1/1987 | Stern et al. . | |
| 4,703,785 | 11/1987 | Antos et al. | 222/538 X |
| 4,756,481 | 7/1988 | Leuenburger | 239/332 |
| 4,801,088 | 1/1989 | Baker | 239/332 X |

FOREIGN PATENT DOCUMENTS

| | | | |
|---|---|---|---|
| 0249209 | 6/1987 | European Pat. Off. . | |
| 0249227 | 6/1987 | European Pat. Off. . | |
| 0285153 | 3/1988 | European Pat. Off. . | |
| 0286072 | 4/1988 | European Pat. Off. . | |
| 1449554 | 8/1966 | France . | |
| 1516180 | 3/1968 | France | 239/154 |
| 61-200182 | 12/1986 | Japan . | |
| 63-1675 | 7/1988 | Japan . | |
| 63-1676 | 7/1988 | Japan . | |
| 63-1677 | 7/1988 | Japan . | |
| 63-168077 | 11/1988 | Japan . | |
| 1-145215 | 6/1989 | Japan . | |
| 76212363 | 3/1988 | Taiwan . | |
| 351443 | 7/1931 | United Kingdom . | |

OTHER PUBLICATIONS

1985 Spring Summer Sears Catalog—p. 727, "There's More for Your Life".

Asahipen America Brochure "The Portable Painting Machine", A 9800, 1128 Spokane St., Seattle, Wash., 98134.

*Primary Examiner*—Andres Kashnikow
*Assistant Examiner*—Kevin Weldon
*Attorney, Agent, or Firm*—Hill, Steadman & Simpson

[57] ABSTRACT

A carrying case is provided for a paint sprayer that, when the paint sprayer is removed, functions as a paint container for the paint sprayer. The case has a removable top wall or lid to provide good access into the container for placing or removing the sprayer and other accessories. A standard, medium-sized garbage can liner can be placed inside the container, held in place when the lid is snapped on, to greatly simplify clean-up.

22 Claims, 3 Drawing Sheets

COMBINATION CARRYING CASE/PAINT CONTAINER

This is a continuation of application Ser. No. 232,082, filed Aug. 15, 1988, now abandoned.

BACKGROUND OF THE INVENTION

The present invention is related to carrying cases for paint spray equipment and, more particularly to a carrying case for a cup gun airless sprayer.

Painting equipment, and including airless cup gun paint sprayers commonly are sold in a kit form which includes a paint sprayer, extra nozzles, swirl valves, suction kits and hoses, cleaning supplies and other small parts, all of which are oftentimes carried in a molded plastic container. The type of container commonly used by the assignee of the present application is a clam shell like container in which the two halves are joined along one edge in a molded hinge and latch portions are molded onto the sides opposite the hinge so that as the container is unlatched and pivoted open, the hollow interior provides the space for receiving all of the parts of the kit. Thus, the container provides a handy means for transporting all of the pieces of the kit to the work site and for acting as a storage receptacle for all of the parts while the paint sprayer is not in use.

Oftentimes there are other components or parts utilized in paint spraying which cannot fit within the carrying case, such as a large capacity paint reservoir or container which is sometimes provided and is connected to a cup gun in lieu of the smaller reservoir cup. In some instances, these larger capacity reservoirs are provided with straps so that the container can be carried by the person doing the painting, such as on the person's back so that the entire system is portable with the user.

Since the extra capacity reservoir is useful in connection with many painting jobs, it would be an improvement in the field if a carrying case were provided which would also accommodate the large paint reservoir.

SUMMARY OF THE INVENTION

The present invention provides an improved carrying case for paint spraying equipment which, when all of the equipment is removed from the carrying case, doubles as a large capacity reservoir thereby reducing the need for an additional component, being either the carrying case or reservoir, reducing storage space necessary for the entire assembly of components, and providing such an additional feature at a cost substantially less than providing a carrying case and separate large capacity reservoir. The carrying case has a removable top wall or cover providing access to the interior thereof for storage of the components. The carrying case also includes attachment points for straps so that once the components have been removed, the carrying case can act as a large capacity paint container which can be carried on the person through the use of such straps. An extension tube is provided which can be attached to the bottom of the lid to extend down into the container so that most of the paint in the reservoir will be drawn out through the tube.

The back pack has a large removable lid covering the entire top of the container which snaps on and off to provide access to the interior for storage of the components and for receiving a supply of paint. The lid has formed in it a pair of tubes or nipples for receiving hoses connected to the cup gun, one being a supply hose and one being a return hose.

Straps can hook on to recessed ears on the side of the container to permit the container to be carried on the back of the user.

DETAILED DESCRIPTION OF THE PREFERRED EMBODIMENTS

Figure 1:
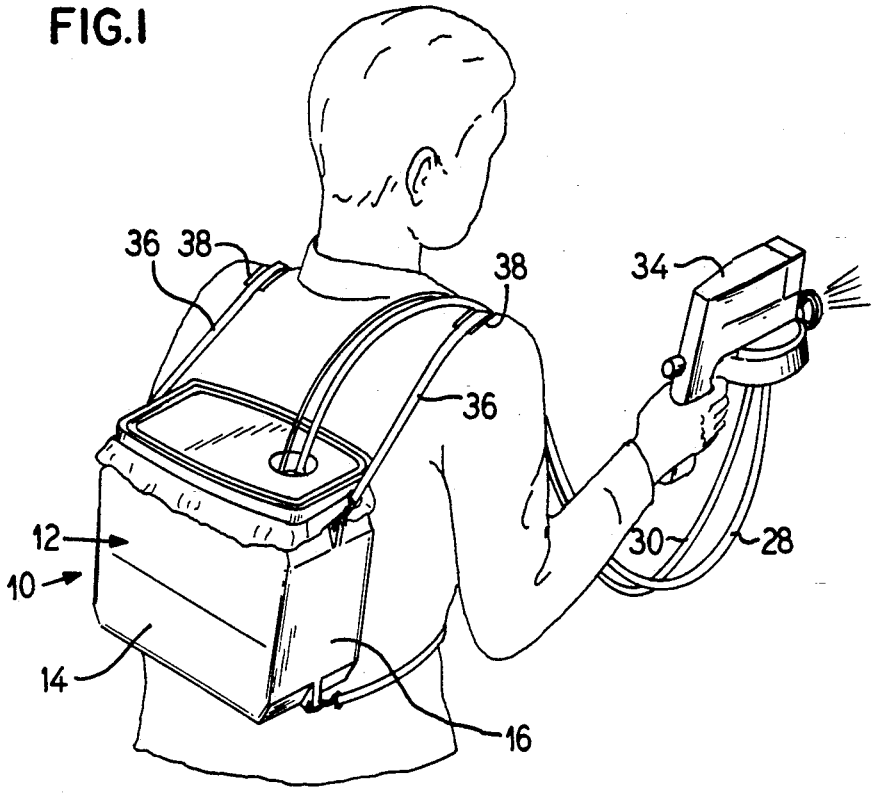
FIG. 1 is a perspective view of the back pack/storage case of the present invention, being carried by a user in its capacity as a back pack reservoir.

FIG. 1 illustrates a back pack/storage container generally at 10 embodying the principles of the present invention and is shown in use as a back pack paint reservoir. The principal component of the invention is a box-like housing 12 which is generally rectangular in shape and has four solid side walls, 14, 16 a solid bottom wall 20 and a removable top wall forming a lid or cover 22.

Figure 2:
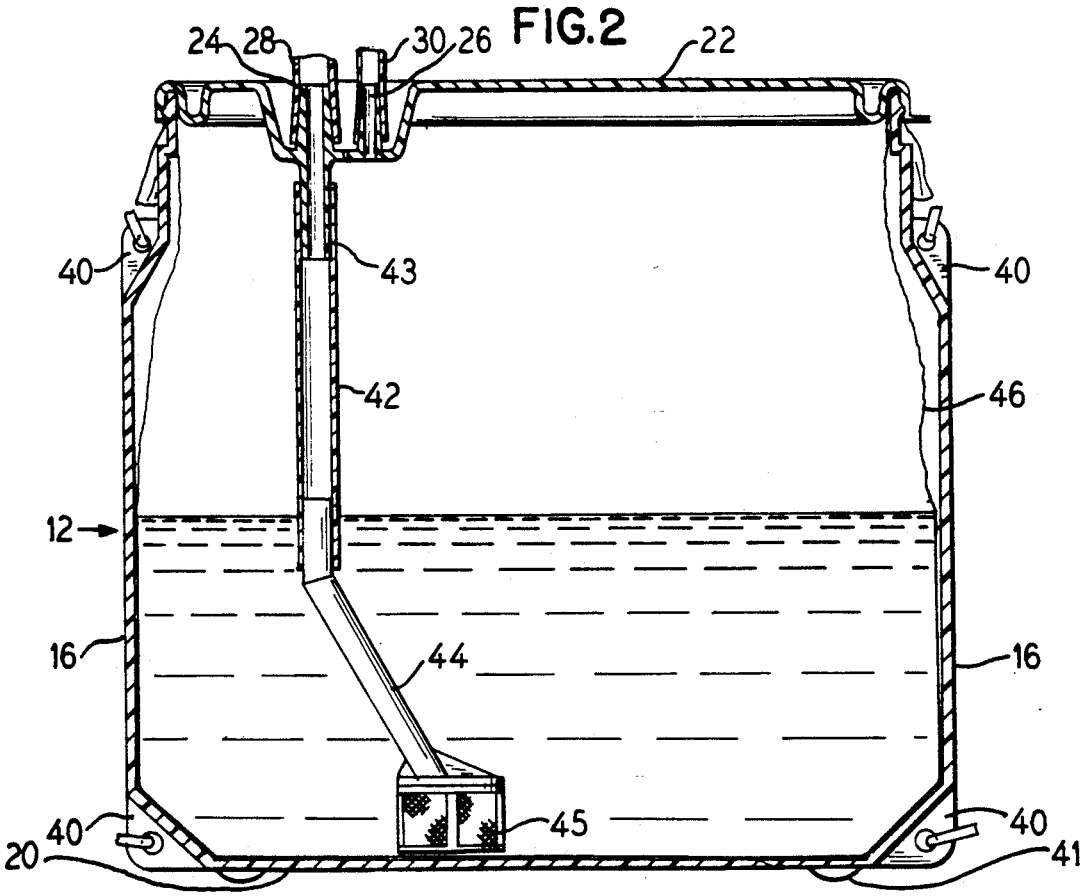
FIG. 2 is a side sectional view of the back pack/storage container of the present invention in use as a back pack reservoir.
Figure 3:
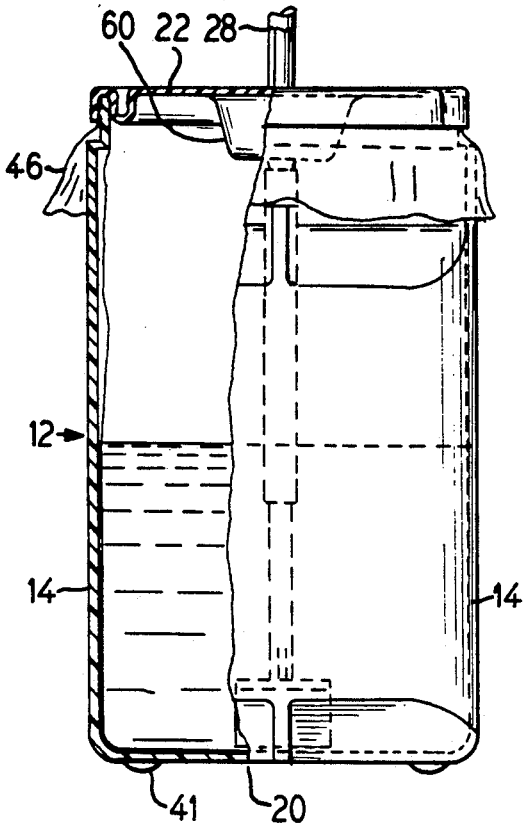
FIG. 3 is a partial side sectional and partial elevational view taken generally 90° to the view of FIG. 2.
Figure 4:
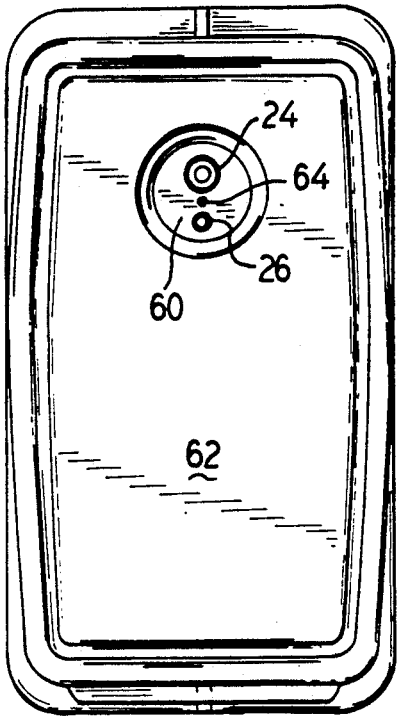
FIG. 4 is a top elevational view of the container of FIG. 2.

As best seen in FIGS. 2 and 4, cover 22 has a pair of apertured nipples 24, 26 for receiving the ends of hoses 28, 30 which are attachable to an airless paint spray cup gun 34 or other type of paint sprayer. A first one of the hoses 28 is a supply hose for the cup gun which draws the paint from the reservoir back pack 10, through the hose 28, and to an inlet fitting on the cup gun. The second hose 30 is provided to direct paint back into the reservoir that is "blow by" paint which passes the piston in the cup gun. A pair of straps 36 with shoulder pads 38 (FIG. 1) are provided which clip onto recessed ears 40 on the side walls 14, 16 of the container to permit the container to be readily carried on the user's back. The container bottom wall has four spaced feet 41 which extend slightly from the bottom wall and assure that the container will rest steadily on a support surface engaged by the feet when the container is not being carried by the user.

When the container is in use as a paint reservoir, an extension tube 42 is inserted onto a downwardly extend portion 43, of the suction nipple 24 and a pickup tube 44 with a screen filter end 45 is attached to that. This pickup tube 44 is the same one that is used by the cup gun when using a small cup reservoir. The pickup tube extends down to the bottom wall 20 of the container so that paint is drawn from near the bottom of the container to assure that as much paint as possible is withdrawn from the interior of the container. Preferably, a plastic liner 46 such as a medium size trash can liner is inserted into the container 12 prior to filling the container with paint so that clean-up is accomplished merely by discarding the plastic liner after the excess paint has been poured out. However, the use of such a liner is not necessary and the container will function properly if paint is applied directly into the interior of the container.

Figure 6:
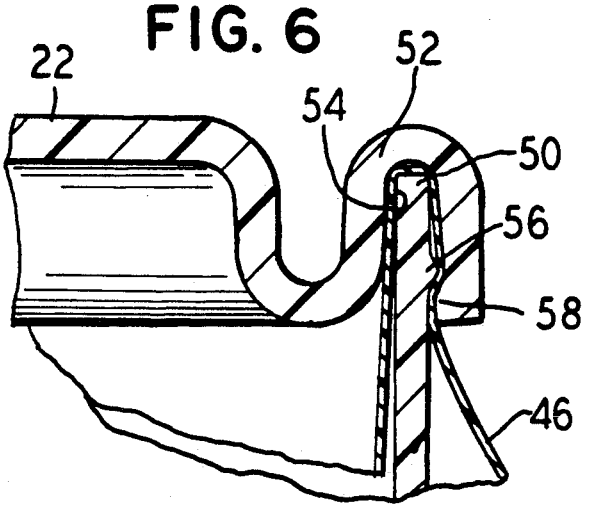
FIG. 6 is a large sectional view of the lid attachment area.

As most clearly seen in FIG. 6, the removable lid 22 snaps onto a top end 50 of the sidewalls 14, 16 of the container 12 and has an S-shaped perimeter 52 with a downwardly opening channel 54 for receipt of the top ends 50. The top ends 50 have an outwardly directed rib 56 formed thereon and the lid 22 has an inwardly directed rib 58 which is pressed down over the sidewall rib 58 such that a liquid tight seal is provided when the lid is snapped onto the container. The container and lid are formed of a resilient plastic material such that there is sufficient flexibility between the parts to permit a liquid tight seal with or without a plastic liner inserted between the liquid and container.

The lid also includes a well 60 (FIG. 2) where the two nipples 24, 26 are located. Thus, the tops of the nipples are not at an elevated position relative to a top face 62 of the top wall or lid 22. A vent hole 64 is also provided in the well 60 to prevent the formation of a vacuum within the container as paint is drawn from the container into the cup gun for spraying.

Figure 5:
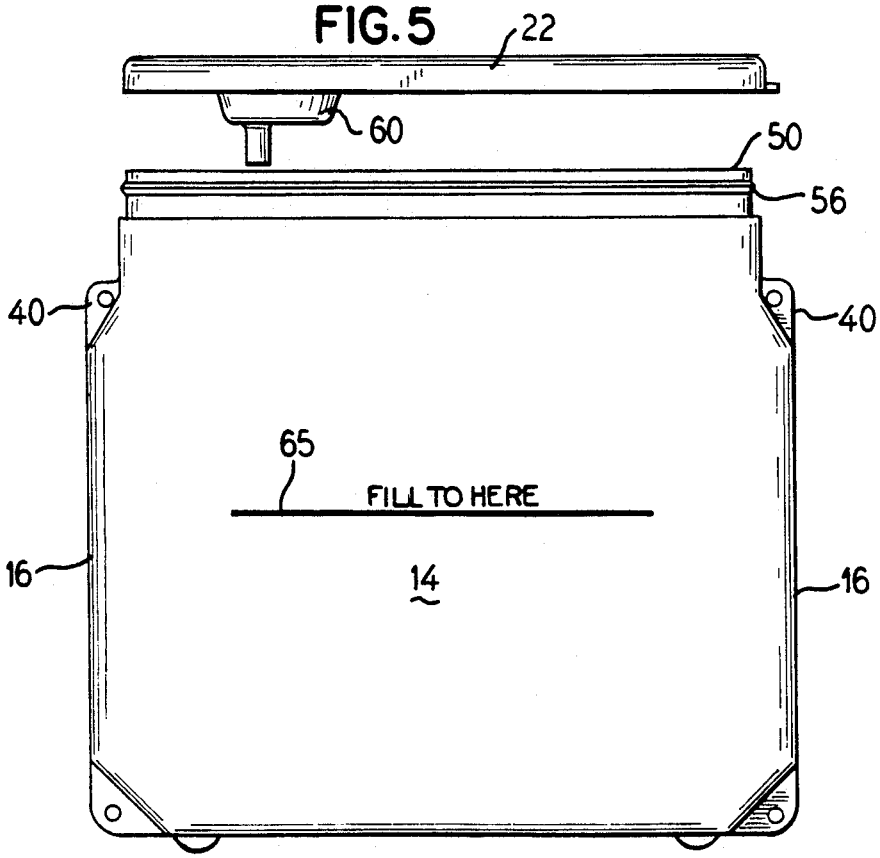
FIG. 5 is an elevational view of the back pack/storage container.

A fill line 65 (FIG. 5) is provided on the exterior of the container at approximately the 1 gallon level which represents an amount that can be carried on the user's back without being too great of a load while standing or climbing a ladder.

Figure 7:
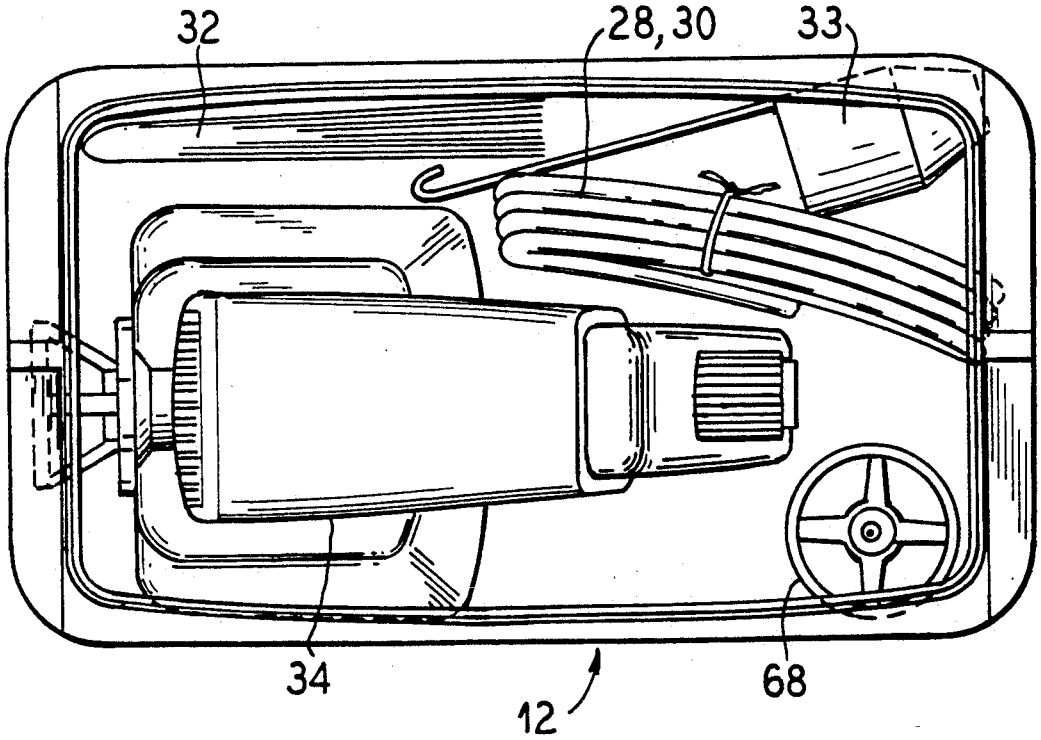
FIG. 7 is a top view of the back pack/storage container with the lid removed illustrating the components being carried when the combined device is functioning as a storage container.

FIG. 7 illustrates the container when it is functioning as a storage container for the paint spraying equipment. Thus, it is seen that the cup gun 34 and its smaller capacity cup 66 as well as additional components such as extra nozzles 68, the hoses 28, 30, instruction manuals 32, viscosity cup 33 and other component parts and accessories can all be carried and stored within the container when the container is not being used as a paint reservoir. Thus, transportation of all of the materials necessary for completing a painting project can be carried in a single container which is compact and which doubles as a large paint reservoir which can be used either setting on a support surface or being carried by the user. The use of the paint reservoir container as the storage container also reduces storage space requirements for the painting components since a separate carrying case and paint reservoir container are not required. By recessing the ears 40 and the nipples 24, 26 so that they do not project beyond the surrounding surface, packaging of the container into a carton is simplified and damage to the carton from protruding parts is avoided.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A carrying case for normally storing a paint sprayer, si paint sprayer having a spray nozzle for ejecting paint a pump for supplying paint to said nozzle and an electric motor for driving said pump, said carrying case comprising a paint container for paint after the paint sprayer is removed, said carrying case including a removable lid comprising substantially the entire top wall of said case providing a large opening for receiving said paint sprayer for normal storage after periodic use of said carrying case as a paint container, said carrying case being dimensioned such that said paint sprayer occupies a major volume interior of said carrying case when stored therein, wherein said lid includes at least one apertured nipple positioned in a well in said lid so as to not protrude beyond a top surface of said lid, said at least one nipple providing a communication path from said container to said paint sprayer.

2. A carrying case according to claim 1, wherein said case includes means for attaching a pair of shoulder straps so that said container can be carried by a user in a portable manner.

3. A carrying case according to claim 2, wherein said means for attaching said shoulder straps comprise apertured ears formed on said container.

4. A carrying case according to claim 3, wherein said ears are formed on side walls of said container and are recessed so as not to project beyond said walls.

5. A carrying case according to claim 1, wherein said lid engages with said container in a liquid tight, snap-on connection.

6. A carrying case according to claim 5, wherein said lid and container are constructed and dimensioned to provide a liquid tight, snap-on connection when a thin plastic liner is inserted between said lid and container.

7. A paint spraying kit comprising:

a paint sprayer comprising:

a spray nozzle for ejecting paint;

a pump for supplying paint to said nozzle;

an electric motor for driving said pump; and switch means for activating said motor;

accessories including a hose for connection to said paint sprayer;

a carrying case for storing said paint sprayer and accessories comprising a housing member having a bottom wall and side walls and are movable lid forming a top wall, said housing defining an interior space dimensioned such that said paint sprayer and accessories occupy a major volume of said interior space when stored therein, said removable lid engaging with said housing member in a liquid-tight, snap-on connection, said carrying case further comprising a paint container for said paint sprayer after said paint sprayer and accessories are removed, said removable lid including at least one apertured nipple providing a communication path from said container to said sprayer with said hose securable to said nipple at one end and to said sprayer at a second end.

8. A carrying case according to claim 7, wherein a suction tube depends from said lid to a bottom of said container.

9. A carrying case according to claim 7, wherein said lid includes means for attaching a return hose which provides a communication path from said paint sprayer to said container.

10. A carrying case according to claim 9, wherein said means for attaching said suction hose and means for attaching said return hose comprise two apertured nipples positioned in a well in said lid so as to not project beyond an exposed surface of said lid.

11. A paint spraying kit comprising:

a paint sprayer comprising:

a spray nozzle for ejecting paint;

a pump for supplying paint to said nozzle;

an electric motor for driving said pump; and switch means for activating said motor;

accessories for use with said paint sprayer; and a carrying case for normally storing said paint sprayer and said accessories, said carrying case being dimensioned such that said paint sprayer and accessories occupy a major volume interior of said carrying case when stored therein, said carrying case further comprising a paint container for the paint sprayer after the paint sprayer and accessories are removed, said carrying case including a removable lid incorporating connection fittings supplying a communication path between an interior of said carrying case and said paint sprayer during use of said paint sprayer, said removable lid further comprising substantially the entire top wall of said carrying case resulting in a large opening in said carrying case for receiving said paint sprayer and accessories so they may be returned into said carrying case for normal storage after periodic use of said paint sprayer.

12. A paint spraying kit according to claim 11, wherein said accessories include a hose to connect said paint container to said paint sprayer.

13. A paint sprayer kit according to claim 11, wherein said accessories include a pair of straps engageable with said container to assist a user in carrying said container.

14. A paint spraying kit according to claim 11, wherein said lid includes at least one apertured nipple positioned in a well in said lid so as to not protrude beyond a top surface of said lid, said at least one nipple providing a communication path from said container to said paint sprayer.

15. A paint spraying kit according to claim 11, wherein said carrying case further includes at least one apertured ear formed on a side wall of said carrying case for receiving a shoulder strap, said ear being recessed so as not to project beyond said wall of said carrying case.

16. A paint container for a paint sprayer, said paint sprayer having a spray nozzle for ejecting paint, a pump for supplying paint to said nozzle and an electric motor for driving said pump, said paint container including a removable lid providing access to an interior of said container and including means for attaching a suction hose which forms a communication path from said container to said paint sprayer, said paint container further comprising a carrying and storage case for said paint sprayer when said container is not being used to hold paint, said paint container being dimensioned such that said paint sprayer occupies a major volume interior of said paint container when stored therein.

17. A paint container according to claim 16, wherein a liquid tight seal means is provided between said lid and said container.

18. A paint container according to claim 16, wherein said lid comprises a top wall of said container.

19. A carrying case for normally storing a paint sprayer, said paint sprayer having a spray nozzle for ejecting paint, a pump for supplying paint to said nozzle and an electric motor for driving said pump, said carrying case comprising a paint container for holding paint spray after the paint sprayer is removed, said carrying case including a removable lid comprising substantially the entire top wall of said case providing a large opening for receiving said paint sprayer for normal storage after periodic use of said carrying case as a paint container, said carrying case being dimensioned such that said paint sprayer occupies a major volume interior of said carrying case when stored therein, wherein said lid includes means for attaching a suction hose which provides a communication path from said container to said paint sprayer.

20. A carrying case according to claim 19, wherein, said carrying case further includes at least one apertured ear formed on a side wall of said carrying case for receiving a shoulder strap, said ear being recessed so as not to project beyond said wall of said carrying case.

21. A carrying case for normally storing a paint sprayer, said paint sprayer having a spray nozzle for ejecting paint, a pump for supplying paint to said nozzle and an electric motor for driving said pump, said carrying case comprising a paint container for holding paint spray after the paint sprayer is removed, said carrying case including a removable lid comprising substantially the entire top wall of said case providing a large opening for receiving said paint sprayer for normal storage after periodic use of said carrying case as a paint container, said carrying case being dimensioned such that said paint sprayer occupies a major volume interior of said carrying case when stored therein, wherein said lid includes at least one apertured nipple positioned in a well in said lid so as to not protrude beyond a top surface of said lid, said at least one nipple providing a communication path from said container to said paint sprayer.

22. A method of utilizing spray painting accessories, said method comprising the following steps:

providing a container having a removable lid;

providing sprayer components including a paint sprayer having a spray nozzle for ejecting paint, a pump for supplying paint to said nozzle, and an electric motor for driving said pump, said sprayer components being stored within said container;

removing said sprayer components from said container;

at least partially filling said container with paint;

using said spray components to spray paint from said container;

cleaning said container and said spray components; and replacing said spray components into said container.

* * * * *

UNITED STATES PATENT AND TRADEMARK OFFICE

CERTIFICATE OF CORRECTION

PATENT NO. : 5,248,089
DATED : September 28, 1993
INVENTOR(S) : Wayne Bekius

It is certified that error appears in the above—identified patent and that said Letters Patent is hereby corrected as shown below:

Column 3, line 63, "si" should read --said--;

line 64, there should be a "," after "paint"(first occurrence)

Column 4, line 38, the words "are movable" should read

--a removable--.

Signed and Sealed this

Thirty-first Day of January, 1995

*Attest:*

*Attesting Officer*

BRUCE LEHMAN

*Commissioner of Patents and Trademarks*